US005092577A

United States Patent [19]

Schmitz et al.

[11] Patent Number: 5,092,577

[45] Date of Patent: Mar. 3, 1992

[54] ROTARY VACUUM CAM DEVICE FOR PLACING INSERTS INTO A PACKAGE

[76] Inventors: Eugene J. Schmitz, 1771 Brighton Beach, Menasha, Wis. 54952; Leon E. Anderson, P.O. Box 363, Denmark, Wis. 54208

[21] Appl. No.: 509,512

[22] Filed: Apr. 11, 1990

[51] Int. Cl.[5] ..... B65H 5/08

[52] U.S. Cl. ..... 271/11; 271/112

[58] Field of Search ..... 271/11, 99, 112, 276

[56] References Cited

U.S. PATENT DOCUMENTS

| | | | |
|---|---|---|---|
| 2,834,596 | 5/1958 | Halahan et al. | 271/99 |
| 3,726,454 | 4/1973 | Robbins | 271/99 |
| 3,797,822 | 3/1974 | Anderson | 271/99 |
| 3,851,871 | 12/1974 | Aronson | 271/11 |
| 4,179,113 | 12/1979 | Gallimore | 271/12 |
| 4,369,964 | 1/1983 | Jinnai et al. | 271/276 |
| 4,484,735 | 11/1984 | Gol | 271/11 |
| 4,548,395 | 10/1985 | Snellman et al. | 271/11 |
| 4,651,983 | 3/1987 | Long | 271/35 |

*Primary Examiner*—David H. Bollinger
*Attorney, Agent, or Firm*—Fuller, Ryan & Hohenfeldt

[57] ABSTRACT

A vacuum aperture in a rotatable cam bears on an insert in an insert magazine when the cam is at rest. The vacuum port sucks the insert up against the face of the cam and away from the inserts in the magazine. When the cam is rotated and accelerated to belt speed the insert is stripped out of the magazine and follows the cam as a cam follower into the nip of the transport belts where the insert is transported to a package. Stripping the insert as a cam follower allows very high feed speeds to be attained. A single electric motor drives the transport belts and through a single cycle electric clutch the same motor accelerates and rotates the cam. A controller connected to a pulse generator, an electric clutch, a package detector and an insert detector control the device. When a package is detected, the cam is rotated and the insert is stripped from the magazine into the transport belts; a detector located between the transport belts determines if an insert has been stripped from the magazine into the belts. If an insert has not been stripped, a repeated stripping attempt is made. If unsuccessful, a reject gate and an alarm are operated which rejects the package not receiving an insert and sounds an alarm.

14 Claims, 5 Drawing Sheets

ROTARY VACUUM CAM DEVICE FOR PLACING INSERTS INTO A PACKAGE

BACKGROUND OF THE INVENTION

The invention is a device for placing inserts, such as coupons, into or onto packages, as the packages move past the inserting device. The device uses a rotating vacuum cam to remove one insert at a time from a magazine of inserts and then feeds the insert into a target package.

DESCRIPTION OF THE RELATED ART

All art addresses the task of delivering a single insert from a stack of inserts into a moving package on a single signal. The problem addressed by this device is that of missed delivery of inserts to packages or of double deliveries. Another problem addressed is insert feeding problems caused by the changing weight of a column of inserts bearing against the mechanism that strips inserts from the column.

Another problem addressed is the skewing of inserts on outfeed belts caused the unpredictable acceleration given to inserts by friction accelerating devices.

Much of prior art uses rotating belts or rotating friction wheels that contact a bottom insert, in a magazine, stripping the bottom insert from the insert magazine, accelerating the insert to the speed of the friction wheel and then feeding the stripped insert into moving outfeed belts.

The adjacent insert, in the magazine, is prevented from being pulled along with the stripped insert by a doctor blade. The area between the doctor blade and the stripping wheel is adjusted to be wide enough to allow only one insert at a time to pass through the opening formed between the doctor blade and the stripping wheel.

The force pushing the inserts towards the friction wheel, either gravity or a separate pushing device, together with the "adjacent insert to adjacent insert" resistance to sliding, causes the inserts to stick together, to double feed and to jam between the stripping wheel and the doctor blade.

Prior art devices are fed inserts from an insert feed trough having a large vertical component or from a powered insert magazine. Gravity or the powered magazine forces the inserts against the friction wheel or vacuum stripping device. The weight of the stack of inserts changes as the stack gets shorter, leading to feeding problems. As the stack gets shorter less force is provided by the remaining inserts in the stack to force the bottom insert against the stripping wheel.

The coefficient of friction between the bottom insert and the stripping wheel is approximately three times the friction between the bottom insert and the insert immediately above it. When moving belts or wheel encounter the insert, the insert is sheared off the bottom of the stack through a narrow opening formed between the stripping device and a sweep knife or doctor blade.

The newer plastic inserts are thin plastic sheets. The inserts generate static electricity when slid against each other. The static electricity in combination with "adjacent insert to adjacent insert" friction makes the thin plastic inserts difficult to strip one at a time. Adjusting the opening between the doctor blade and the take off means to make an opening that will allow only one thin plastic insert to pass through at a time, is difficult.

An example of a friction wheel removal system combined with an insert pushing device is shown in U.S. Pat. No. 4,651,983.

Without a stack pushing device, as the height of the stack of inserts shrinks, the force on the friction wheel lessens causing feeding problems. Apparatus designed to provide a uniform insert bearing force on a stripping device is shown in U.S. Pat. No. 4,179,113.

The cited prior art devices strip the insert out of the bottom of the feed tray while accelerating the insert and feeding the insert into moving outfeed belts. That is they pull each insert from the bottom of the stack downwards, as the insert passes across the bottom of the stack support, the stripped insert is slid down across its adjacent insert.

Another insert feeding device uses a vacuum cup mounted at the end of a swing arm. A cup with a multitude of vacuum ports pulls the insert out of a magazine, while fingers retain the remainder of stacked inserts in the magazine. The swing arm is pivoted away from the stack and over a package and the vacuum is released.

Shown in U.S. Pat. No. 4,179,113 is an insert magazine holding inserts that bear against a vacuum slide. The insert held by the vacuum, is slid downward out of the stack and then is released into other machinery which transports the insert to a package.

SUMMARY OF THE INVENTION

The invention is a redesign of the insert stripping and accelerating mechanism and is a method for stripping and feeding an insert.

In the redesign, the insert was designed to be held to a cam and to follow the cam as a cam follower. A cam is usually a plate or cylinder which communicates motion to a follower by means of its edge or a groove cut in its surface. *Mark's Mechanical Engineer's Handbook,* Eighth Edition, McGraw Hill Book Company, Sec. 8.4.

In the practical design of a cam, the follower must assume a definite series of positions or must arrive at a definite position by the time the driver arrives at a particular location. Marks op. cit.

In this device, the insert, acting as a cam follower, must arrive at the nip point of two parallel outfeed belts while being carried by the cam.

The cam must operate at such a speed that the follower will be picked up gradually by the gentle ramp portion of the cam. Marks op. cit. A dwell time was designed into the invention to allow the cam to pick up the insert. The smooth acceleration and deceleration of the cam was considered and a modified wrap spring clutch was incorporated to provide the smooth acceleration.

The second design criteria centers around finding the particular relationship between the follower and cam position that results in minimum forces and impacts so that the speed can be made quite large. *Marks op. cit.*

The speed of this device is such that often more than one try can be made if necessary, to strip and feed an insert to a package, as the package moves past the device.

In petitioner's device, the bottom insert, in a magazine of inserts is first sucked up against a vacuum port in a rotatable cam. The insert is bent away from the stack by the vacuum force, which bears on the top of the face of the insert. The cam is held against the insert, to be removed from the stack, at a slight angle, and for a dwell time, to ensure that the insert is captured by and held by the vacuum port on the cam. During this dwell time, the insert contacted by the vacuum port is pulled up against the port and is pulled partly away from the adjacent insert in the stack. The cam is then activated and the cam with the attached insert is accelerated and rotated and the attached insert is rotated from the adjacent insert, out of the top of the stack into the nip of continuously moving out feed belts, through an electric eye, to a package.

The invention employs a nearly horizontal feed tray or a magazine containing rows of inserts. A feed tray or magazine with a large vertical component is not necessary because frictional pick up of the insert is not used to pull the insert from the stack. Individual inserts are not slid out of the stack while totally bearing face to face on each other; they are rotated out of the stack. The doctor blade, vacuum cam, separation is not critical because the top edge of the insert is rotated away from the adjacent insert while at the same time the face of the cam below the vacuum port is rotating away from the insert stack. Use of a nearly horizontal feed tray allows the tray to be easily refilled and eliminates the effect of weight change as the feed tray empties.

As stated, inserts are placed face to face in a magazine. The insert at the lower end of the magazine abuts a vacuum port in a rotatable cam. The vacuum port bears on the insert near the top of the face of the insert and as the cam is rotated the vacuum port pulls and rotates the insert out of the top of the stack of inserts into the nip of moving outfeed belts.

As the insert is passed along the transport belts, the insert passes in front of a photo eye.

If no insert is detected by the photo eye, through a time established by an encoder, a signal is sent to reactivate the clutch and another attempt is made to feed an insert within the time the package to be filled is in front of the out feed belts.

If the repeat cycle is missed, an output signal triggers an alarm or gives a signal to divert or reject the missed package.

The preliminary pulling away of the insert from the adjacent insert, in the stack of inserts, by the vacuum cam and then rotating the insert out of the stack around the arc of travel of the cam serves to break the adhesion of the stripped insert from the adjacent insert and minimizes double feeds of inserts.

Because of the shallow angle of the feed tray, made possible by this vacuum cam device, the device can be mounted overhead of a product line. A highly angled feed tray on a device mounted above a product line, is hard to fill because of the height of the magazine. The shallow feed angle is an advantage.

Mounted outside of the device is an optical sensor responsive to the movement of a package. Upon the optical sensor detecting a moving package, an electronic signal is sent to an electrical solenoid, which releases a one revolution clutch. Upon release of the clutch, the vacuum port cam rotates through 360 Degrees to its place of beginning.

An insert held by the vacuum port in the cam is pulled away from and rotated out of the top of the insert stack, into the nip of out-feed belts which strip the insert from the cam. The insert is propelled by the out feed belts into a package, while the cam rotates back to the stack of inserts with the vacuum port bearing on the next insert in the stack.

The cam, with its vacuum port, can be positioned so that the feeder can feed inserts from a horizontal to a vertical position.

It is an object of the invention to produce an insert feeding device that can operate at high insert feed speeds, up to 500 inserts per minute.

It is an object of the invention to provide an insert feeding device that eliminates parts that must start and stop intermittently.

It is an object of the invention to produce an insert feeding device that can feed inserts with the device mounted from a vertical to a horizontal position.

It is an object of the invention to produce an insert feeding device using a vacuum pickup that does not require a large vacuum manifold.

It is an object of the invention to produce an insert feeding device using a vacuum pickup that does not need to incorporate a means to shut off the vacuum when the insert is stripped from the vacuum pickup.

It is an object of the invention to eliminate mechanical swing arms and to use all rotary feeding means.

It is an object of the invention to produce an insert feeding device incorporating a single electric motor.

It is an object of the invention to provide a vacuum cam insert feeding device which will operate based on an electrical triggering signal generated by a moving package rather than to have to tie the device mechanically or electrically to the packaging equipment.

It is an object of this invention to develop an insert feeding device that will work with newer thin plastic inserts.

DESCRIPTION OF THE PREFERRED EMBODIMENT

Figure 1:
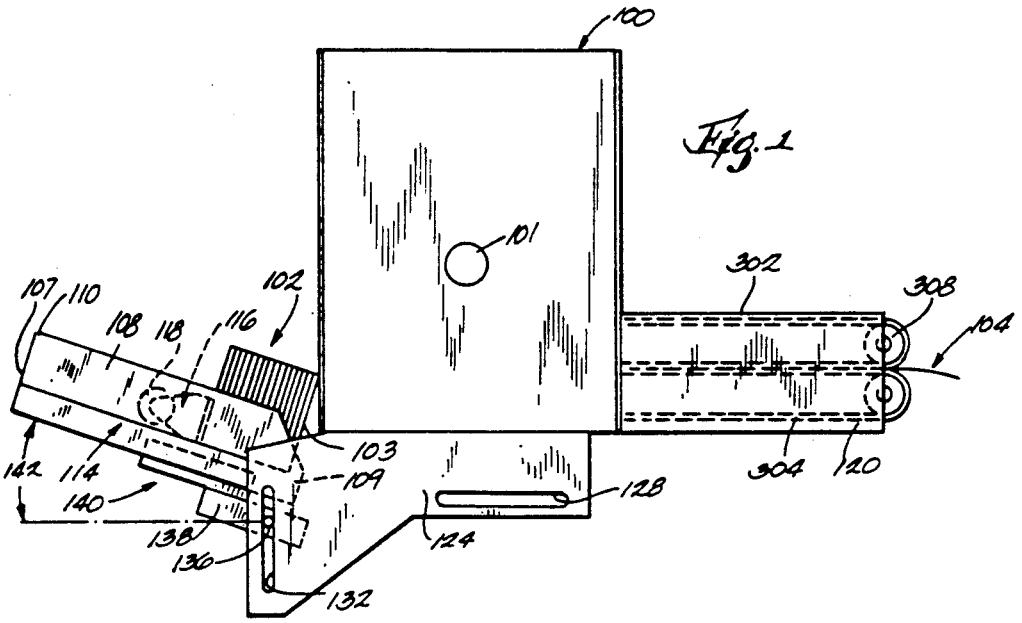
FIG. 1 is a side view of the insert feeder.

A list of the elements of this invention includes the following parts:

| | |
|---|---|
| Insert Feeder | 100 |
| Horizontal Mounting Post Hole | 101 |
| Stack of Inserts | 102 |
| Lowest Insert | 103 |
| Individual Insert | 104 |
| Individual Insert Face | 105 |
| Insert Spacing | 106 |
| Insert Magazine Lower End | 107 |
| Insert Magazine | 108 |
| Insert Magazine Lower End | 109 |
| Insert Magazine Side Wall | 110 |
| Insert Magazine Side Wall | 112 |
| Insert Magazine Bottom | 114 |

-continued

| | |
|---|---|
| Insert Magazine Foot Stop | 115 |
| Stack Pusher | 116 |
| Stack Pusher Roller | 118 |
| Outfeed Roller Side Support | 120 |
| Outfeed Roller Side Support | 122 |
| Magazine Support Plate | 124 |
| Magazine Support Plate | 126 |
| Magazine Height Adjustment Slot | 128 |
| Magazine Height Adjustment Slot | 130 |
| Magazine Height Adjustment Slot | 132 |
| Magazine Height Adjustment Slot | 134 |
| Magazine Pivot Pin | 136 |
| Magazine Pivot Block | 138 |
| Magazine Mounting Block | 140 |
| Magazine Feed Angle | 142 |
| Mechanical Drive Mechanism | 200 |
| Drive Motor | 202 |
| Motor Shaft | 204 |
| Motor Driven Sprocket Gear | 206 |
| Sprocket Drive Belt | 208 |
| Sprocket Gear | 210 |
| Main Drive Shaft | 212 |
| Outer Drive Sprocket | 214 |
| Transport Drive belt | 216 |
| Camshaft Roller Pulley | 218 |
| Upper Infeed Roller Drive Disc | 220 |
| Upper Infeed Roller | 221 |
| Clutch Drive Sprocket | 222 |
| Upper Infeed Roller Grooves | 223 |
| Clutch Output Sprocket | 224 |
| Clutch Output Shaft | 225 |
| Camshaft Drive Belt | 226 |
| Insert Transport Mechanism | 300 |
| Upper Transport Belts | 302 |
| Nip | 303 |
| Lower Transport belts | 304 |
| Transport Belt Vertical Spacing | 306 |
| Upper Out Feed Roller | 308 |
| Lower Outfeed Roller | 309 |
| Lower Infeed Roller | 330 |
| Lower Infeed Roller | 332 |
| Infeed Pulley Support Bearings | 334 and 336 |
| Infeed Pulley Support Bearings | 338 and 340 |
| Lower Infeed Pulley Grooves | 342 and 344 |
| Insert Support Discs | 346 and 348 |
| Camshaft Assembly | 400 |
| Vacuum Output Cam Shaft on which Cam is Mounted | 402 |
| Rotatable Cam | 404 |
| Arc of Travel of Cam | 405 |
| Vacuum Port | 406 |
| Vacuum Port Recess Area | 408 |
| Vacuum Access Passage or Manifold | 410 |
| Vacuum Circuit | 411 |
| Exterior of Camshaft | 413 |
| Stripper Blade or Doctor Knife | 416 |
| Stripper Knife Support Block | 418 |
| Stripper Blade, Vacuum Cam Spacing | 419 |
| Insert Dispensing Angle | 420 |
| Insert Deflection | 421 |
| Cam Shaft Bearing | 422 |
| Cam Shaft Bearing | 424 |
| Vacuum Source | 426 |
| Rotary Union | 428 |
| Shaft Collar | 430 |
| Cam Stop Position | 432 |
| Electrical Control Mechanism | 500 |
| Package | 501 |
| Product Photo sensor | 502 |
| Product Photo Sensor Signal | 504 |
| Electrical Controller | 506 |
| Electrical Clutch | 508 |
| Electrical Clutch Operating Signal | 509 |
| Electrical Clutch Solenoid | 510 |
| Electrical Signal Generator | 512 |
| Electrical Signal From Signal Generator | 514 |
| Tip Sensor | 516 |
| Electrical Inlet | 518 |
| Clutch Pawl | 520 |
| Fault Signal | 522 |
| Tip Sensor Photocell Signal | 524 |
| Reject Gate | 526 |

-continued

| | |
|---|---|
| Alarm | 528 |

FIG. 1 is a side view of an insert feeder 100. At the center is shown mounting support post hole 101.

A stack of inserts 102 is placed in insert magazine 108. The inserts 102 are placed generally vertically in face to face relationship between the insert magazine side walls 110 and 112, resting on the insert magazine bottom 114.

The stack of inserts 102 slides from the upper end 107 of the magazine 108 to the lower end 109 of the magazine.

A stack pusher 116, having a stack pusher roller 118 mounted thereon, holds the stack of inserts 102 vertically and urges the stack 102 downwards towards the device 100.

At the right of feeder 100 are mounted two extensions 120 and 122 which serve as outfeed roller side supports for outfeed rollers.

Below the device 100 ar the magazine support plates 124 and 126. Two sets of height adjustment slots 128 and 130, and 132 and 134 are provided. Set 128 and 130 are used if the device 100 is to be mounted dispensing vertically. Sets 132 and 134 are used if the device is to be mounted dispensing horizontally.

Figure 12A:
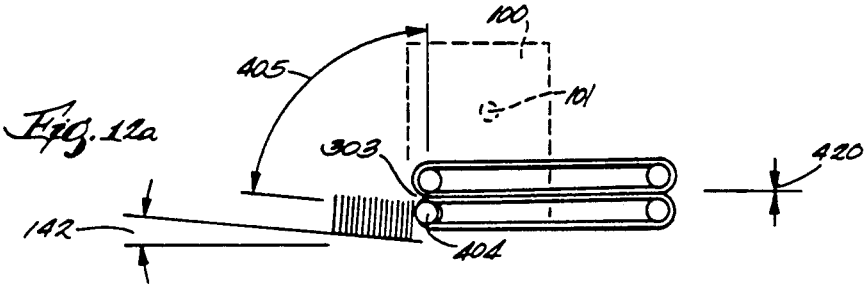
FIGS. 12*a*, 12*b* and 12*c* are three views showing different cam follower arcs of travel.
Figure 12B:
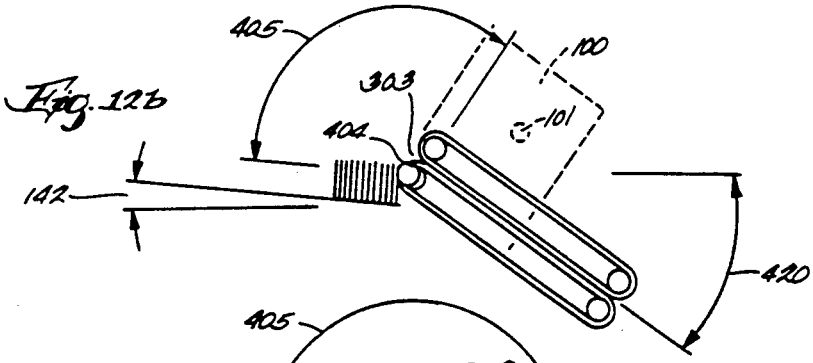
Figure 12C:
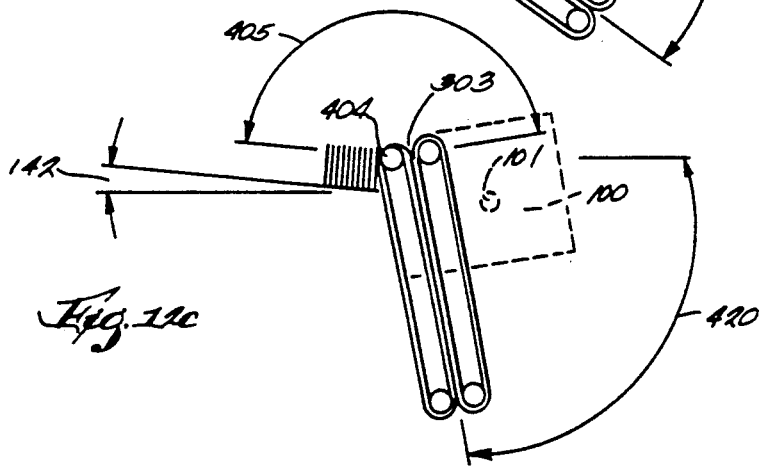

As shown in FIG. 12 the device can be mounted from a vertical position to a horizontal position. The magazine 108 remains in the same magazine feed angle 142 regardless of the insert dispense angle 420 of the device 100.

Magazine height adjustment slot 132, magazine pivot pin 136, magazine pivot block 138 and magazine mounting block 140 are shown to the left of FIG. 1.

Figure 11:
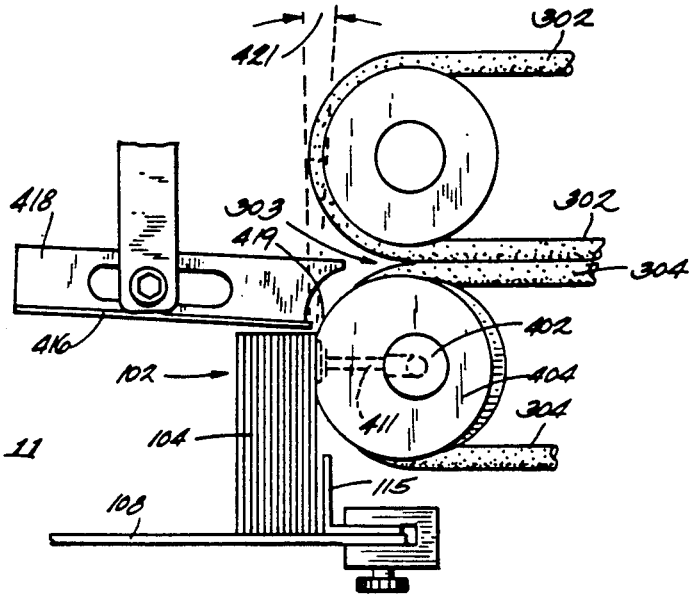
FIG. 11 is an expanded schematic side view of the vacuum port, insert interface.

The magazine 108 ca be moved vertically to adjust the device to various size inserts and to adjust the vertical position of the vacuum cam insert interface as shown in FIGS. 11 and 12.

The device 100 pivots around the mounting hole 101 and the magazine 108 pivots around pivot pin 136. As stated, this pivoting ability allows the device to be operated through a wide feed angle from vertical to horizontal.

FIG. 1 shows the shallow feed angle 142 of the magazine 108.

FIG. 1 shows the device 100 attached to magazine 108 with stacked inserts 102 fed into device 100 with individual inserts 104 being ejected singly out of the opposite side of the device 100. The individual inserts 104 are transported out of the device by four parallel outfeed belts. Two belts above and two belts below, spaced apart from each other hold the inserts 104 and transport the inserts 104 out of the device 100.

Figure 2:
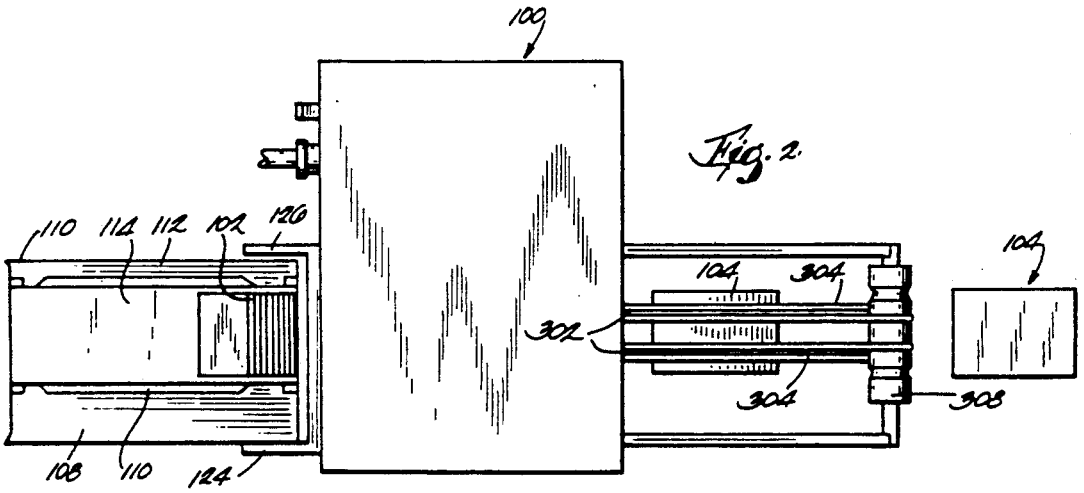
FIG. 2 is a top view of the insert feeder.

FIG. 2 is a top view of the device 100. To the left of FIG. 2 is the magazine 108, comprising adjustable magazine side wall 112, adjustable side wall 110 and bottom 114. The spacing of side walls 110 and 112 can be adjusted to accommodate different sized inserts.

Inserts 102 are shown in magazine 108. Magazine supports 124 and 126 can be seen at the end of magazine 108. Vacuum source 426 and electrical inlet 518 are shown on the top left of device 100.

To the right of FIG. 2 is shown an ejected insert 104, outfeed roller side supports 120 and 122 and upper outfeed roller 308.

An insert 104 held between and being transported by belts 302 and 304 is also shown.

Figure 3:
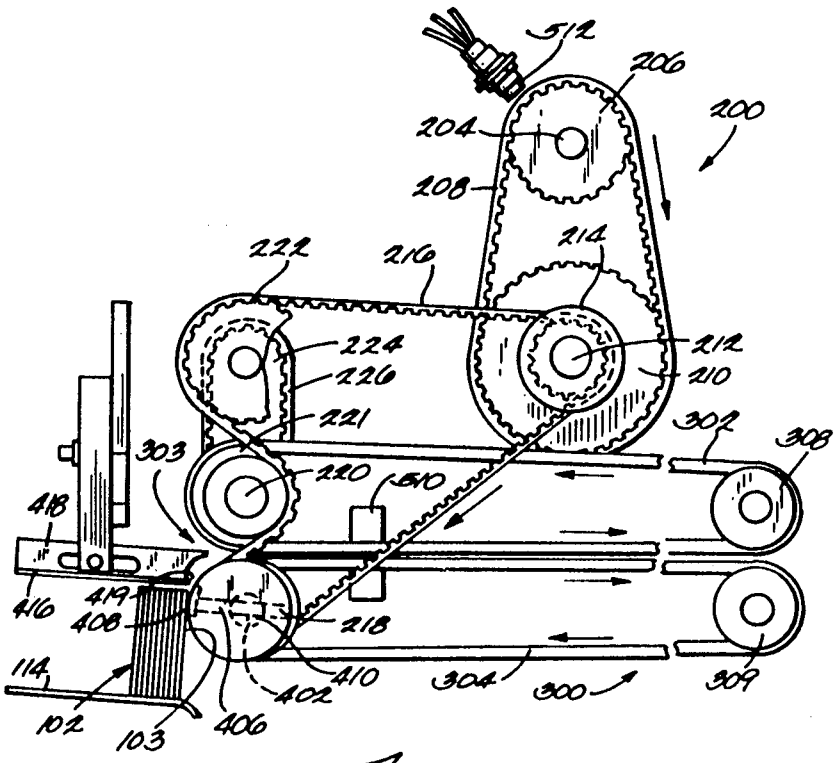
FIG. 3 is section view showing the drive mechanism of the insert feeder.

FIG. 3 is a side view, in section of the mechanical drive mechanism.

The mechanical drive mechanism 200 of the insert feeder 100 is provided as follows.

First reviewing FIG. 3. Motor shaft 204 extends out of the single electrical drive motor 202 used. Motor shaft 204 is affixed to motor driven sprocket gear 206.

Sprocket drive belt 208, a timing belt, is driven by sprocket gear 206 and in turn drives sprocket gear 210. Sprocket gear 210 is journaled to main drive shaft 212. Direction of movement of belt 208 is shown by an arrow. Belt 208 continuously runs and provides the power to drive outfeed belts 302 and 304 which carry inserts 104 out of the device 100. In the best method, belts 302 and 304 are constantly in motion and the drive train to these belts is not subject to starting and stopping loads.

Journaled to main drive shaft 212 and stacked on to gear 210 is outer drive sprocket 214. Mounted on outer drive sprocket 214 is transport drive belt 216.

Figure 4:
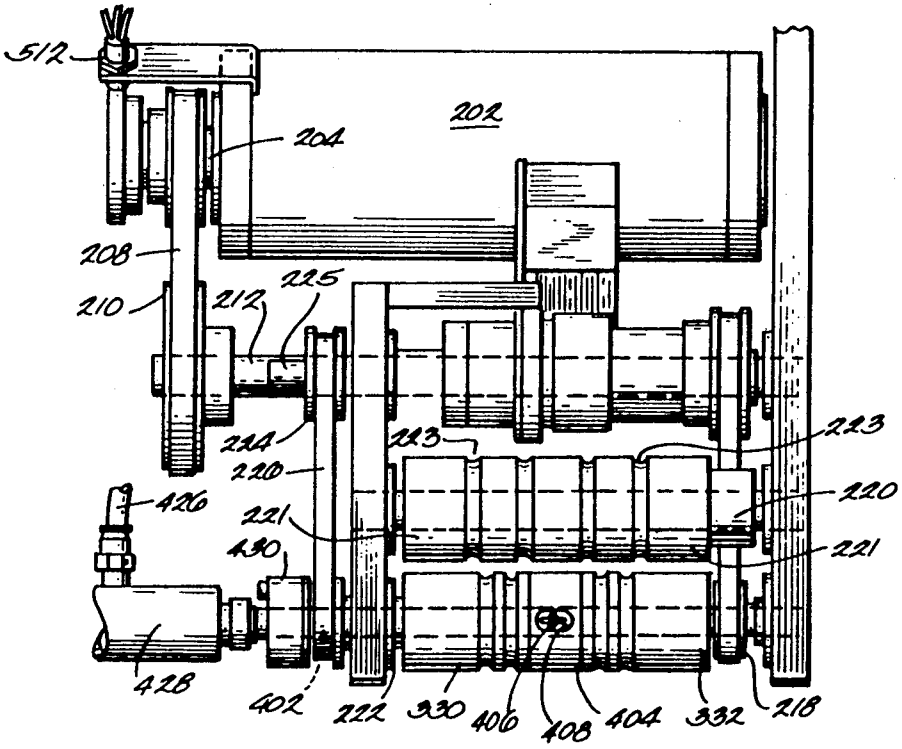
FIG. 4 is a front view into the feeder with the cover removed.

Drive direction of transport drive belt 216 is shown by the arrow in FIG. 3. Transport drive belt 216 passes around camshaft roller drive pulley 218 as shown in FIG. 4, then around upper infeed roller drive disc 220, then around clutch drive sprocket 222 and back to outer drive sprocket 214.

A partial section has been taken out of clutch drive sprocket 222 to show part of the clutch output sprocket 224 and its associated drive belt 226. Electrical clutch 508, not shown in this drawing, engages the clutch drive sprocket 222 to the clutch output sprocket 224 upon receiving a signal from the electrical clutch controller 506.

In operation, belt 208 is always in motion and being driven. Belt 216 and its associated sprockets are always in motion.

Drive belt 226 is only driven and in motion when the electrical clutch 508 has activated by a product feed signal 516 and the clutch output sprocket 224 is then connected to the main drive shaft 212, through belt 216 and associated sprockets.

Insert transport mechanism 300 as shown in FIG. 3 comprises upper transport belts 302 and lower transport belts 304. Generally two upper transport belts 302 and two lower transport belts 304 are mounted above and below the outlet from the stripping mechanism 400. The stripping mechanism is the nip 303 of the belts. That is, the belts are one above and one below the cam 404 in the arc of travel 405 of the cam. The transport belts 302, 304 transport the individual inserts 104 away from the cam 404 to the package.

The horizontal spacing 306 of belts 302 and 304 can be varied to accommodate different sizes of inserts being fed.

Transport belt 302 extends around upper out feed roller 308 and is driven by upper infeed roller 221.

Transport belt 304 extends around lower outfeed roller 309.

Vacuum output cam shaft 402 is shown in hidden lines on the camshaft roller pulley 218 in FIG. 3

Shown on the left bottom of FIG. 3 is a stack of inserts 102.

The inserts 102 are stacked in a column. The face of the lowest insert 103 in the column 102 rests against vacuum port 406 in cam 404. Cam 404 has a vacuum port 406 and a vacuum port recess area 408 formed therein. The shaft 402 upon which the cam is mounted, has been drilled out to form a vacuum access passage.

Above the inserts 102 is shown stripper blade 416 which is mounted on stripper blade support block 418. The inserts to be stripped are pulled through the stripping blade, vacuum cam spacing 419.

The stripper blade 416 is adjustable in position in height, angle and depth to accommodate different size inserts and to accommodate the desired insert dispensing angle 421 as shown in FIGS. 11 and 12.

FIG. 12 is a schematic showing three dispensing angles 420 through which the device can be used by rotating the device around the mounting 101 and 136 and by changing the radial position of the vacuum cam 404 on vacuum cam shaft 402.

FIG. 4 is a front view of the device with the support structure removed. The purpose of this view is to show the power train and the lateral position of all parts.

Upper infeed roller 221 is affixed to upper infeed roller drive disc 220 Upper infeed roller 221 turns continuously as long as power is fed to motor 202.

Upper transport belts 302 are affixed around upper infeed roller 221, in grooves 223. The belts 302 are not shown in this view. As stated, two upper transport belts 302 are used. There are four transport belt retainer grooves 223 in roller 221 so that the transport belts can be spaced to accommodate different width inserts.

FIG. 4 shows electric motor 202, as connected to three drive belts, 208, 216 and 226.

For belt 226 to be driven, electrical clutch 508 must be engaged.

At the bottom of FIG. 4, vacuum rotary union 428 is shown mounted to camshaft 402. Movable shaft collar 430 is used to adjust the cam stop position 432.

Camshaft 402 is hollow up to the vacuum port 406. The hollow is a vacuum access passage or manifold.

The vacuum port 406, in the best method is approximately one sixteenth of an inch diameter. The vacuum source 426 is a remote pump not shown. No vacuum shut off is used. The size of the port 406 is such that during the short cycle of the vacuum cam, where the cam 404 is not closed off by an insert 104 vacuum is not materially lost.

When electrical clutch 508 is engaged, clutch output shaft 225 on which is mounted clutch output sprocket 224 moves belt 226 which in turn powers cam drive sprocket 222 which turns vacuum output shaft 402.

Vacuum port recess area 408 is designed to maximize surface contact and to minimize vacuum loss. In the best method, the area is approximately one half inch.

At the upper left of FIG. 4 is shown electrical signal generator 512.

Figure 5:
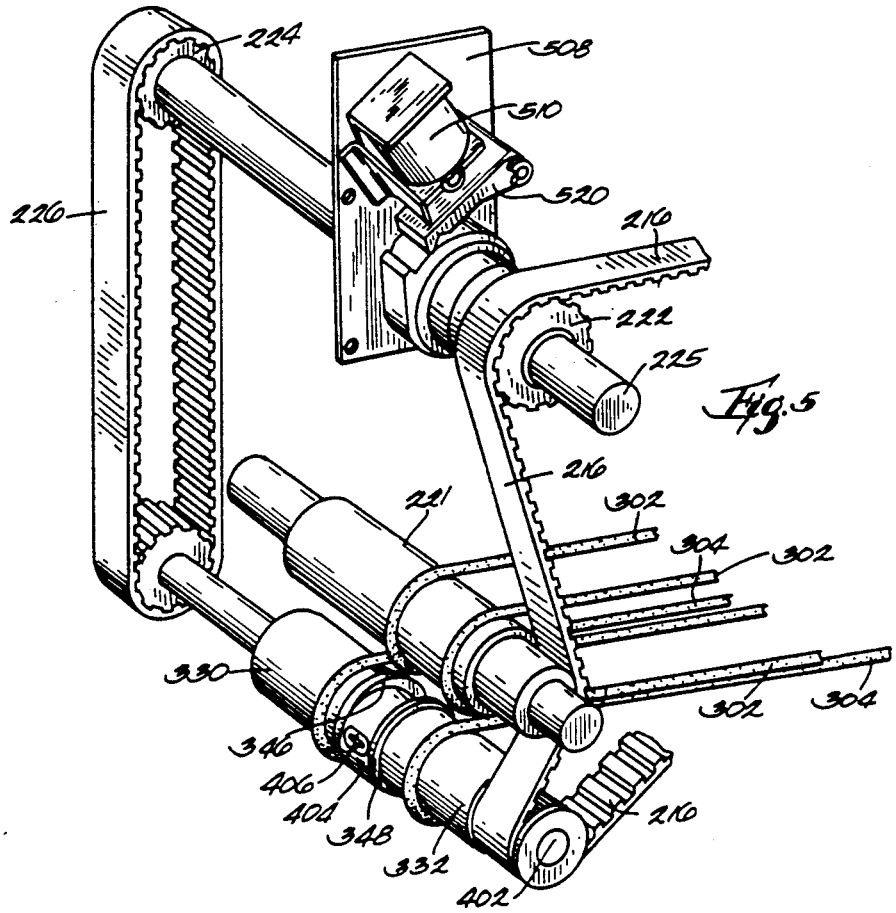
FIG. 5 is a perspective view of the clutch and cam drive mechanism and the outfeed belts.

FIG. 5 is an expanded perspective view of the clutch and cam drive mechanism and the outfeed belts.

Clutch output shaft 225 is stationary until clutch 508 is engaged. In use, clutch 508 is engaged upon the electrical controller 506 receiving a product feed signal 516.

Prior to engaging clutch 508, transport drive belt 216 is turning. Clutch drive sprocket 222 is idling on shaft 225.

Outfeed belts 302 and 304 are turning, moving outwards away from nip 303. Rollers 221 and 223 are turning.

Cam 404 is stationary. On both sides of stationary cam 404 are free rotating insert support discs 346 and 348.

The discs 346 and 348 serve to prevent bouncing of the insert stack 102 when the cam 404 is rotated with camshaft 402.

Upon receipt of a product feed signal 516 from the controller 506, electrical clutch 508 is engaged. In the best method a modified wrap spring clutch is used because of the smooth acceleration characteristics of a wrap spring clutch. The wrap spring clutch 508 brings clutch output shaft 225 up to the transport belt speed in approximately three milliseconds.

The insert 104, held by vacuum port 406 is accelerated, and rotated out of the stack 102, in an arc of travel 405, into the nip 303 of outfeed belts 302 and 304.

Electrical clutch 508, engages solenoid 510 which lifts pawl 520. On one 360 degree rotation of the shaft, the pawl reengages, terminates cam movement, and starts a dwell period.

Programmed into the controller 506 is a programmed count, counting corresponding magnetic pulses 514 generated by generator 512 which is operated off main motor shaft 204.

A delay of approximately three motor revolutions is programmed into the controller, before the clutch 508 can be again engaged and the cam rotated again.

The dwell time is designed to allow the vacuum to build up and the port 406 pick up an insert 104 and pull the insert away from the stack 102.

The present device operates at 520 revolutions per minute. Dwell time in the current device is determined to be a minimum of three milliseconds between rotations of the cam 404 to build up vacuum at the port 406 and for the cam 404 to engage an insert.

Figure 6:
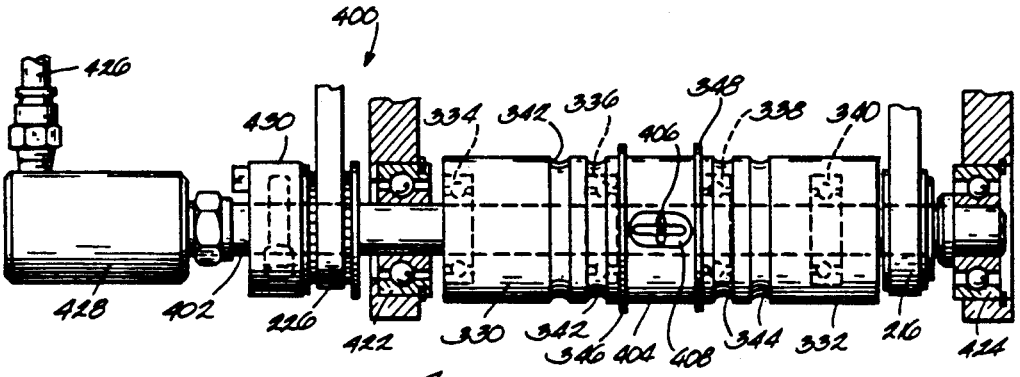
FIG. 6 is a front view of the assembled vacuum camshaft.

FIG. 6. Camshaft assembly 400 includes cam shaft 402 and associated rollers 330 and 332. Rollers 330 and 332 are mounted in bearings 334 336, 338, and 340 to turn freely on cam shaft 402. Roller 332 is driven by transport drive belt 216. Mounted between rollers 330 and 332 are free floating insert support discs 346 and 348. Cam shaft 402 has a vacuum access passage 410 formed through approximately one half of the cam shaft 402 length.

Cam shaft bearing 422 and cam shaft bearing 424 support cam shaft 402.

Vacuum port 406 is formed radially through the camshaft 402. Cam 404 is press fit onto and around camshaft 402, centered over vacuum port 406.

FIG. 6 shows the cam 404 with its vacuum recess area 408 mounted at the center of the cam shaft 402 and vacuum port 406 extending outwardly.

Lower infeed pulleys 330 and 332 are always in motion. Infeed pulley support bearing 334 and 336 support pulley 330. Infeed pulley support bearings 338 and 340 support pulley 332.

Lower transport belts 304 not shown in this view are mounted on pulleys 330 and 332 in grooves 342 and 344. Grooves 342 and 344 are not in alignment with the grooves 223 in the upper infeed roller 221. The transport belts 302 and 304 are staggered with zero vertical clearance. The transport belts 302 and 304 are staggered because if they were mounted over each other the belts would interfere with each other.

The cam shaft 402 with its associated cam 404 and vacuum port 406 only rotates when electrical one revolution clutch 504 is triggered.

Returning to FIG. 6 and to the left side of the cam shaft assembly, vacuum source 426 is attached directly to rotary union 428 which is mounted on the camshaft 402. No vacuum manifold is needed because of the design of the vacuum system.

FIG. 6 shows the movable shaft collar 430 used to adjust the position of cam 404.

When the dispensing angle 420 of the device is changed, the cam vacuum port 406 has to be rotated so that the vacuum port 406 is approximately perpendicular to or normal to the face of the insert 104 to be fed.

Shaft collar 430 allows rotating camshaft 402 and its associated vacuum cam 404 to the required position 432 to generate the desired arc of travel 405 to carry an insert 104 to the nip 303 of the outfeed belts 302 and 304.

On the right of FIG. 6 can be seen transport drive belt 216 and on the left side the camshaft drive belt 226 previously described in FIGS. 3, 4 and 5.

Figure 7:
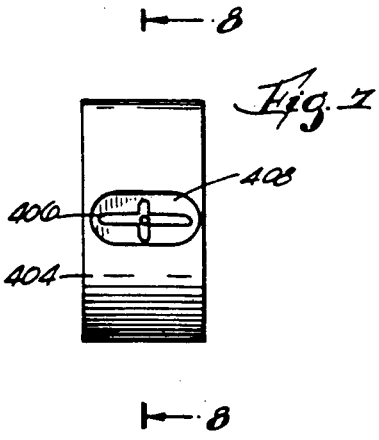
FIG. 7 is a front view of the vacuum cam.

FIG. 7 is a front view of the rotatable cam 404. Vacuum port 406 and vacuum port recess area 408 can best be seen in this view.

Figure 8:
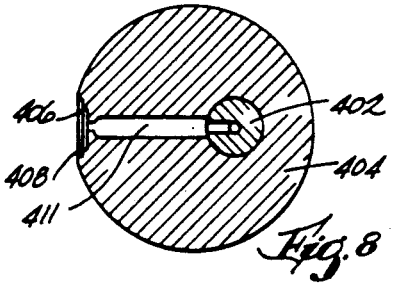
FIG. 8 is a section through the vacuum cam showing the vacuum port.

FIG. 8 is a cross section of the rotatable cam 404 showing the vacuum circuit 411.

Figure 9:
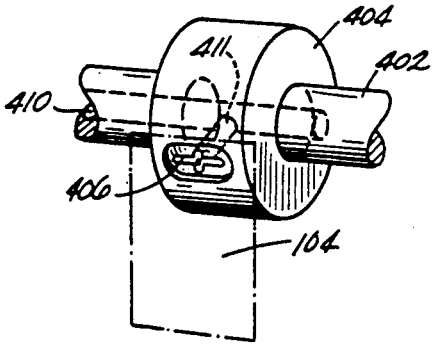
FIG. 9 is a partial section of the vacuum cam and the camshaft.

FIG. 9 is a shadow view of the vacuum cam 404 mounted on shaft 402.

Figure 10:
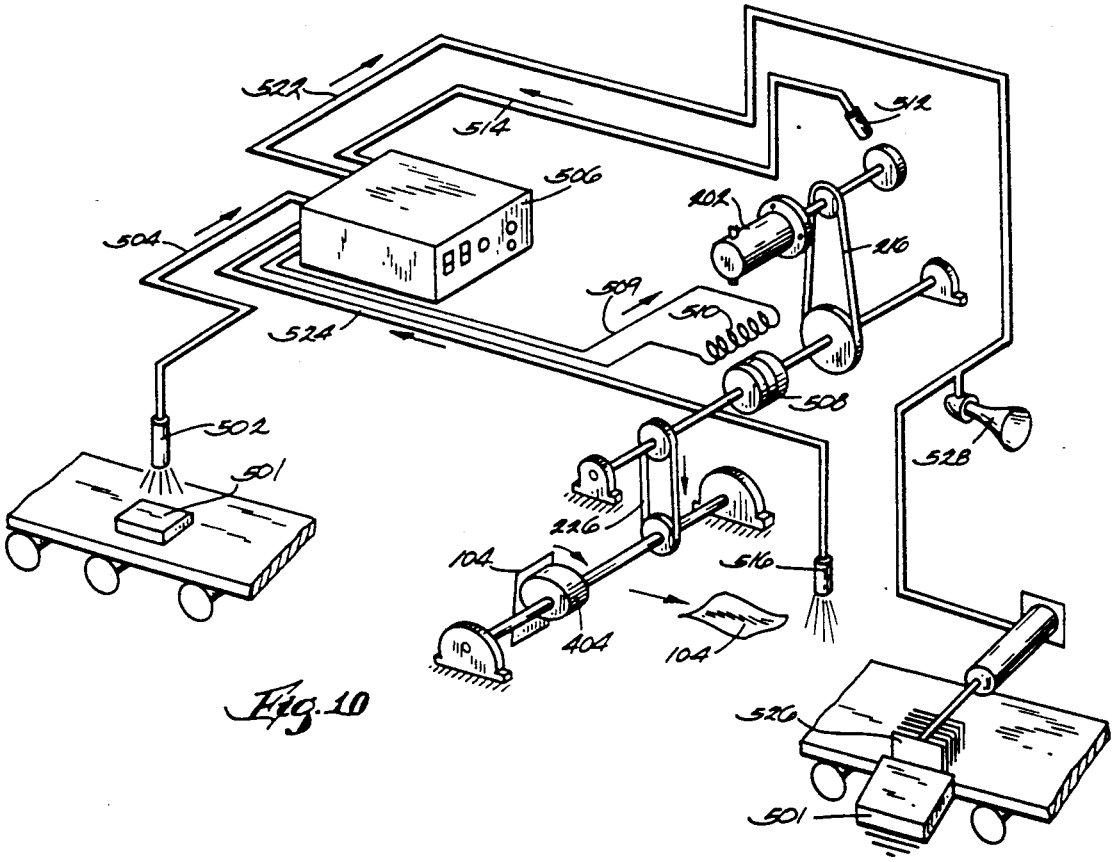
FIG. 10 is a schematic of the operation of the device.

FIG. 10 is a schematic of the device showing the electrical control mechanism 500.

A product 501 passes in front of a product photo sensor 502. Upon product photo sensor 502 detecting the product 501, sensor 502 sends a product photo sensor signal 504 to the controller 506. Controller 506 signals 509, an electrical clutch solenoid 510 to engage a one revolution electrical clutch 508, and at the same time the controller 506 counts the signals 514 generated by signal generator 512 which is mounted to the main drive shaft. Electrical signal generator 512 detects magnetic pulses and converts the pulses into signal 514, generated as so many pulses per inch of coupon travel.

Upon receiving signal 509, the output shaft 225 attached to the camshaft drive clutch 508 rotates 360 degrees driven by belt 226 and its attached camshaft 402. The camshaft 402 with its attached insert 104 rotates through 360 degrees. The camshaft accelerates to output belt speed and while doing so, rotates 360 degrees. The entrained insert 104 is pulled in to the nip of the moving output feed belts which strip the insert off and propel the insert into the product, while the cam rotates back to its point of beginning.

Tip sensor 516 detects whether an insert 104 has passed under tip sensor 516 within the prescribed count received by the controller 506. In the device used, approximately 70 counts, with 20 counts per revolution of the electric motor 202 would correlate with the linear travel of one insert from the magazine through the area scanned by the tip sensor 516.

If no insert 104 is detected within count 514, a second signal 509 is sent to the electronic clutch 508 to make a second try to feed the insert 104.

If no insert 104 is detected on a second attempt to feed an insert, then a fault signal 522, generated by the controller 506 is sent to sound an alarm 528 or to operate reject gate 526, to divert the package 501.

As best seen in FIG. 10 is tip sensor photocell 516 and pulse generator 512.

Tip sensor photocell 516 radiates across the space between belts 302 and 304 to a sensor. An insert 104 passing across this field interrupts the signal 524. If the signal 524 is interrupted this signifies that an insert has passed along the transport belts and therefore into a product.

The tip sensor signal 524 from the tip sensor photocell 516 must be recorded within a programmed count generated by the pulse generator 512.

The pulse generator 512 is operated by a magnetic encoder which is continuously running and is mounted on the motor drive shaft 204.

If no tip sensor signal 524 is received within the count generated by the pulse generator 512, the controller 506 recycles the vacuum cam 404 to pick up another insert.

If no signal 524 is received on the retry a fault signal 522 is generated and an alarm 528 or an output bypass signal or reject signal 526 or both is given. The fault signal 522 is to notify the operator of problems and the reject signal can be used to divert the missed product.

If a set number of inserts in a row is missed the device can be signaled to shut down.

FIG. 11 is an expanded side view of the insert vacuum cam interface.

Inserts 104 are mounted magazine 108. The inserts bear against insert magazine foot stop 115. That stop extends about one third up the insert.

Mounted above stop 115 can be seen cam 404, outfeed belts 302 and 304, and outfeed belt nip 303.

Stripper or doctor blade 416 mounted on stripper knife support block 418 can be seen as can the stripper blade vacuum cam spacing 419.

In the best method, vacuum cam 404 does not stop in a position 432 perpendicular to or normal to an insert. The stop position is approximately one half a degree beyond normal. The stop beyond normal creates an insert deflection 421 of approximately one thirty second of an inch to one sixteenth of an inch depending on the flexibility of the insert 104.

The deflection 421 makes the stripper blade vacuum cam spacing 419 less critical and solves one of the problems in feeding very thin inserts.

FIG. 12 shows the arc of travel 405 of the vacuum cam 404. The greater the angle of feed 420 the greater the arc of travel 405 of the cam 404 with its entrained insert 104. The insert dispense angle 420 as shown in this FIG. depends o the flexibility of the insert.

As the insert dispense angle 420 goes from horizontal to vertical, the insert 104 travels farther along the arc of travel of the cam 405 before being fed into the nip 303.

We claim:

1. In a method of stripping inserts seriatim from a magazine holding a stack of inserts, and then feeding the insert stripped from the magazine into moving transport belts, then to a package, the steps of:

a. positioning a rotatable cam insert stripping means between the inserts in the magazine and the moving transport belts;

b. securing an insert to the cam;

c. generating an electric pulse that is a function of motor rotation;

d. determining the pulse count that will allow an insert to be fed to a package during the period the package will be in position to receive an insert;

e. determining the pulse count that will be generated in the period that an insert will travel from the stationary cam position to the transport belts;

f. signalling a controller that a package has been detected;

g. rotating the cam on receipt of the signal that a package has been detected, while counting the pulses generated, starting at initiation of rotation of the cam;

h. stripping the insert from the cam into the moving transport belts;

i. determining whether an insert has been detected within the transport belts within the pulse period that is generated in the pulse count that an insert will travel from the stationary cam position to the transport belts;

j. comparing the pulse count remaining with the pulse count that will allow an insert to be fed to a package;

k. rotating the cam again if the remaining pulse count will allow an insert to be fed; and again determining whether an insert has been detected within the transport belts within the remaining pulse count;

l. engaging a reject gate if no insert is detected within the remaining pulse count.

2. A method as claimed in claim 1 wherein the cam while being rotated is at the same time accelerated to the speed of movement of the moving transport belts.

3. A method as claimed in claim 1 wherein the cam is rotated 360 degrees for each insert stripped from the cam.

4. The method in claim 1 further comprising an alarm engageable when an insert has failed to feed within a determined pulse count.

5. An insert dispensing device for seriatim feeding of a single insert from a stack of inserts to a package, comprising in combination:

an insert magazine for containing a stack of inserts;

a rotatable cam having a vacuum port formed therein, said cam positionable so that said vacuum port is positioned adjacent to an insert in the stack;

a source of vacuum, operatively connected to the vacuum port, said vacuum operative to secure an insert to the rotatable cam;

a cam rotation means;

a cam rotation operating means operable so as assume an "on" state wherein said cam rotation means is connected to rotate said cam and an "off" state wherein said cam is free from being rotated by said cam rotation means;

insert transport means for feeding an insert stripped from the magazine by rotation of the cam, to said package;

a package sensor means for sensing the approach of said package; and processor and control means operationally connected to said cam rotation operating means and said package sensor means for sending an "on" signal to the cam rotation operation means upon detection of said package by the package sensor.

6. The device in claim 5 wherein the cam rotation means further comprises:

a. a motor;

b. a rotatable camshaft upon which the cam is mounted;

c. a clutch;

d. a drive train connecting the motor and the camshaft through the clutch;

e. a clutch pawl for intermittently engaging the clutch.

7. The device in claim 6 wherein the clutch is a 360 degree single cycle clutch.

8. The device in claim 6 wherein the cam rotation operating means is an electric solenoid operatively connected to the clutch pawl and to the processor and control means.

9. The device in claim 5 wherein the insert transport means comprises:

a. a motor;

b. an upper transport belt;

c. a lower transport belt mounted below said upper transport belt;

d. a nip formed between the upper and lower transport belts, said nip being positioned generally within the arc of travel of the cam;

e. a drive train connecting the transport belts to the motor.

10. The device in claim 5 wherein a single electric motor is used to rotate the cam and to drive the transport means.

11. An insert feeding device for seriatim feeding of a single insert from a stack of inserts to a package, comprising in combination:

a. a package;

b. a magazine of stacked inserts;

c. a rotatable insert stripping means located between the magazine and the transport belts; said insert stripping means bearing on an insert in the magazine;

d. means to secure the insert to the insert stripping means;

e. a motor;

f. a first drive train connecting the motor to the transport belts;

g. an engageable clutch;

h. a second drive train connecting the electric motor to the rotatable insert stripping means through the clutch;

i. a solenoid operable to engage the clutch j. a package sensor means for sensing the approach of a package;

k. a pulse generator means for generating a signal as the motor turns;

l. an insert sensor means for sensing the presence of an insert in the transport belts;

m. a controller means operationally connected to:

1. said pulse generator means;

2. said package sensor means;

3. said solenoid; and 4. said insert sensor means, whereby when a signal is generated by the package sensor means, and received by the controller, the controller in turn generates a solenoid operating signal, causing a rotation of the rotatable insert stripping means, and then counts pulses generated by the pulse generating means; if a signal is not received by said insert sensor means within a predetermined count a second solenoid operating signal is sent, the solenoid again operates and the count is begun again.

12. The device in claim 11 further comprising:

a reject gate means, operationally connected to said controller, operable if an insert is not detected by said insert sensor means within a certain pulse count after said solenoid operating signal is given, to reject a package.

13. The device in claim 11 further comprising:

an alarm means operationally connected to said controller, operable if an insert is not detected within a certain pulse count to give an alarm.

14. A device for placing an insert into a package, as the packages move past the device, comprising in combination:

an inclined magazine having an upper end and a lower end, for holding a plurality of said inserts stacked therein in a manner to permit movement of said inserts toward said lower end of said magazine;

a rotatable cam, having a vacuum aperture formed therein, said rotatable cam and said vacuum aperture positioned such that said aperture bears on the lowest insert in said magazine;

a source of vacuum connected to said rotatable cam, operative to draw an insert against said vacuum aperture and away from any remaining stacked inserts;

means to rotate said cam, while said insert is secured against said vacuum aperture by vacuum from said vacuum source, for rotating said insert out of said magazine through the arc of travel of said cam;

transport means mounted generally within the arc of travel of said cam, for propelling said insert to said package as the package moves past said transport means;

said transport means including at least one upper belt and at least one lower belt, each of said belts reeved about an infeed roller and an outfeed roller, said rollers arranged so that said belts grip said insert within the arc of travel of said cam;

one of said infeed rollers being coaxial with said cam.

* * * * *